US006209427B1

(12) United States Patent
Healy

(10) Patent No.: US 6,209,427 B1
(45) Date of Patent: Apr. 3, 2001

(54) WEDGE TYPE ADJUSTMENT TOOL

(75) Inventor: Donald A. Healy, Conway, AR (US)

(73) Assignee: Snap-On Incorporated, Lincolnshire, IL (US)

( * ) Notice: Subject to any disclaimer, the term of this patent is extended or adjusted under 35 U.S.C. 154(b) by 0 days.

(21) Appl. No.: 09/393,320

(22) Filed: Sep. 10, 1999

(51) Int. Cl.[7] ..... B25B 11/00
(52) U.S. Cl. ..... 81/484; 81/485
(58) Field of Search ..... 81/484, 485, 486, 81/9.24, 3.7, 9.3, 302, 347, 352, 395, 398

(56) References Cited

U.S. PATENT DOCUMENTS 1,814,368 * 7/1931 Chapman ..... 294/106
4,086,828 * 5/1978 Mader ..... 81/3 K
5,212,859 * 5/1993 Hagerty ..... 29/229
5,327,802 * 7/1994 Yu ..... 81/312
5,535,651 7/1996 Perez .
5,590,573 * 1/1997 Detable ..... 81/9.3

* cited by examiner

*Primary Examiner*—Timothy V. Eley
*Assistant Examiner*—Dung Van Nguyen
(74) *Attorney, Agent, or Firm*—McDermott, Will & Emery

(57) ABSTRACT

An adjustment tool is provided for performing vehicle suspension alignment procedures where it is necessary to adjust the space between suspension components. Embodiments include an expanding adjustment tool with a first arm and a second arm that pivots relative to the first arm, and an adjuster, such as a wedge, for moving the first and second arms relative to each other. Both arms have detachable tips, such as spreader plates, yokes, wedges, etc. of different sizes and shapes, which tips are easily interchangeable depending on the particular application. The adjuster is rotatable to adjust the relative positions of the arms, and has an end engagable with a standard ratchet, thereby allowing extensions, swivels, etc. to be connected to the adjuster as needed to facilitate the alignment procedure in tight spaces. Thus, a single adjusting tool easily performs adjustments on a wide variety of vehicles with minimal additional cost.

20 Claims, 6 Drawing Sheets

WEDGE TYPE ADJUSTMENT TOOL

FIELD OF THE INVENTION

The present invention relates to tools used in performing vehicle wheel alignment. he invention has particular applicability to tools for adjustably spacing vehicle suspension components during an alignment procedure.

BACKGROUND ART

When performing vehicle suspension alignment procedures, such as wheel camber adjustment, it is often necessary to adjust spacing between suspension components. For example, when setting camber on a McPherson strut-type suspension, typically the top anchor of the strut to knuckle assembly is loosened to allow movement of the strut, and the wheel is positioned as necessary by changing the position of the strut relative to the frame or knuckle assembly of the vehicle (i.e., by moving the top of the strut towards or away from the longitudinal center line of the vehicle). The top anchor is thereafter secured. When setting camber on a vehicle equipped with an upper wishbone arrangement other than with McPherson struts, the inner anchors of the wishbone are loosened, the wheel positioned as necessary by changing the location of the wishbone relative to the frame or inner body structure of the vehicle (i.e., by moving the wishbone towards or away from the longitudinal center line of the vehicle), and the inner anchors are thereafter secured.

Many vehicle suspension systems do not provide a mechanical means for positioning the wheel during the adjustment procedure, thus requiring manual application of force by the technician to the strut or wishbone to position the wheel. Since suspension adjustment procedures typically require the weight of the vehicle to be on the suspension during the procedure, such application of force can be problematic, depending on the weight of the vehicle and the location of the suspension members. This problem is especially acute if the vehicle is equipped with upper wishbones and "slot-type" adjustment holes for the wishbones.

A tool for moving a suspension member, especially a McPherson strut, to position a wheel is disclosed in U.S. Pat. No. 5,535,651 (Perez). Referring to FIGS. 1A and 1B, Perez teaches an expanding adjustment tool comprising a spreader plate 16 pivotally mounted to an engaging yoke 12, a handle 18 for facilitating placement of the tool between two members to be adjusted, and a crank-operated adjustment assembly 20 for pivoting spreader plate 16 relative to yoke 12. In use, spreader plate 16 engages the frame or inner body of the vehicle, and yoke 12 engages the strut while crank 30 is turned to move spreader plate 16 and yoke 12 apart to move the strut.

Disadvantageously, Perez' adjustment tool is not easily adaptable to perform adjustments on differently-configured vehicles. For example, although spreader plate 16 and yoke 12 are suitably sized for moving the strut on one vehicle, they may be too large or small, or incorrectly shaped, for moving the strut of a different vehicle; e.g., a vehicle produced by another manufacturer. In other words, if the tool is designed to fit a first vehicle, it may not fit between the components of another vehicle, may not bear properly against the components, or both. Similarly, crank 30 is inconvenient to operate on some vehicles due to space constraints, and handle 18 is not of the proper length for manipulation of the tool on some vehicles. Thus, a number of differently sized tools must be purchased and stored if alignment is to be performed on a variety of vehicles, increasing costs. Furthermore, Perez' adjustment tool is not suitable for performing adjustments on vehicles having upper wishbones instead of struts because yoke 12 does not fit between the wishbone and the vehicle frame or inner body.

There exists a need for an expanding adjustment tool for suspension alignment that is usable on a wide variety of vehicles, including vehicles equipped with McPherson struts or upper wishbones.

SUMMARY OF THE INVENTION

An object of the present invention is to provide a single wedge-type adjustment tool that is easily adaptable to perform adjustments on vehicles of different sizes and configurations, including vehicles equipped with McPherson struts or upper wishbones, as well as to perform certain rear suspension adjustments currently performed only with factory-provided special tools.

According to the present invention, the foregoing and other advantages are achieved in part by an adjustment tool comprising a first arm, a first tip detachably mounted to a distal end of the first arm, a second arm pivotably mounted relative to the first arm, a second tip detachably mounted to a distal end of the second arm; and an adjuster for pivoting the first and second arms relative to each other to adjust a distance between the first and second tips. To facilitate mounting and changing of the tips, one of the first and second tips can comprise a socket-like recess, and the distal end of one of the first and second arms may comprise a protruberance having a detent ball for retainably engaging the socket-like recess. To facilitate operation of the adjusting tool of the present invention, the adjuster is rotatable for pivoting the first and second arms relative to each other, and a distal end of the adjuster is engagable with a standard ratchet for rotating the adjuster, or comprises a telescoping crank handle for rotating the adjuster.

Additional objects and advantages of the present invention will become readily apparent to those skilled in this art from the following detailed description, wherein only the preferred embodiments of the present invention is shown and described, simply by way of illustration of the best mode contemplated for carrying out the present invention. As will be realized, the present invention is capable of other and different embodiments, and its several details are capable of modifications in various obvious respects, all without departing from the present invention. Accordingly, the drawings and description are to be regarded as illustrative in nature, and not as restrictive.

BRIEF DESCRIPTION OF THE DRAWINGS

Reference is made to the attached drawings, wherein elements having the same reference numeral designations represent like elements throughout, and wherein.

DESCRIPTION OF THE INVENTION

Conventional expanding adjustment tools are not suitable for use on a variety of differently-configured vehicles, and therefore require separate tools for servicing vehicles of different sizes and structures. Furthermore, conventional adjustment tools are difficult to manipulate in work areas of vehicles having limited free space. The present invention addresses and solves these problems stemming from the lack of versatility of conventional adjustment tools.

The present invention thus provides an expanding adjustment tool with a first arm and a second arm that pivots relative to the first arm, and an adjuster, such as a wedge, for moving the first and second arms relative to each other. Both arms have detachable tips, such as spreader plates, yokes, wedges, etc. of different sizes and shapes, which tips are easily interchangeable depending on the particular application. For example, an appropriately sized spreader plate and yoke are attached to the arms of the inventive tool for adjustment of McPherson strut-type suspensions, while two wedge-shaped tips are attached for adjustment of upper wishbone-equipped vehicles. In one embodiment of the present invention, the adjuster is rotatable to adjust the relative positions of the arms, and has an end engagable with a standard ratchet, thereby allowing extensions, swivels, etc. to be connected to the adjuster as needed to facilitate the alignment procedure in tight spaces. Thus, the present invention enables a single adjusting tool to easily perform adjustments on a wide variety of vehicles with minimal additional cost.

Figure 1A:
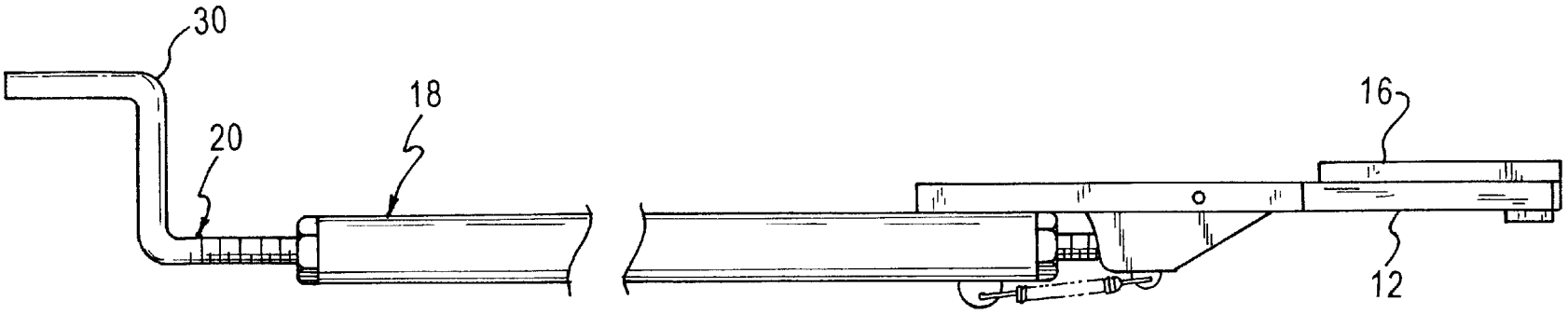
FIG. 1A PRIOR ART
FIGS. 1A–1B illustrate a conventional adjustment tool.
Figure 1B:
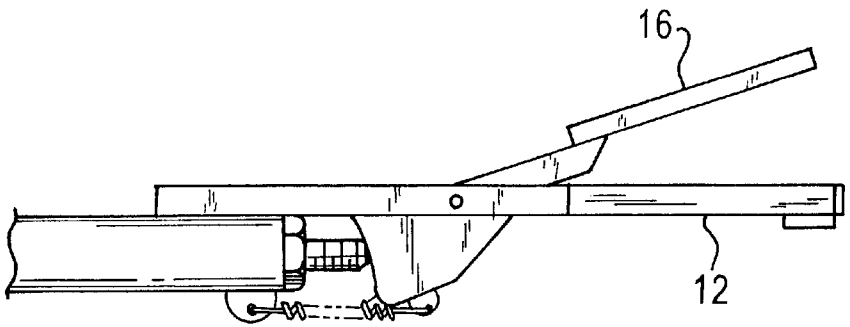
FIG. 1B PRIOR ART
Figure 2:
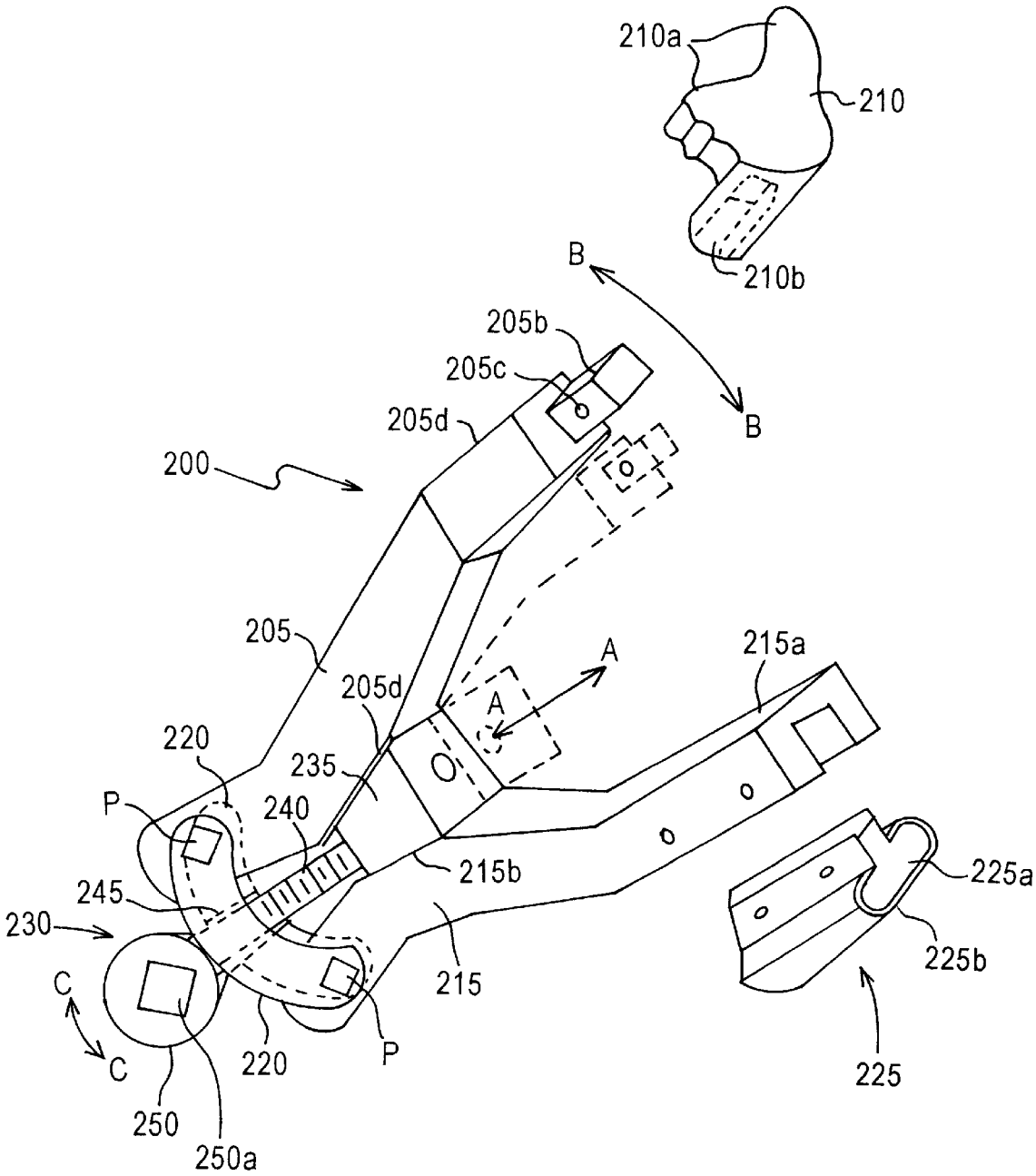
FIG. 2 is a perspective view of an adjustment tool according to an embodiment of the present invention.

An embodiment of the present invention is illustrated in FIGS. 2 and 3A–3C. Referring to FIG. 2, an adjustment tool 200 for adjusting the distance between two members comprises a first arm 205 having a first tip 210 detachably mounted thereto at one end 205*a* for engaging one the members to be adjusted. First tip 210 can be a yoke having a pair of spaced-apart legs 210*a* for engaging one the members to be adjusted, such as a strut in a vehicle suspension. First tip 210 can alternatively be wedge-shaped (not shown), as for engaging an upper wishbone or vehicle frame member. For ease of interchangeability, first tip 210 comprises a female socket-like recess 210*b* (e.g., a ½ inch square recess) for accepting a protruberance 205*b* on distal end 205*a* of first arm 205, which comprises a detent ball 205*c* for securely engaging recess 21 Ob, retaining first tip 210.

Figure 3A:
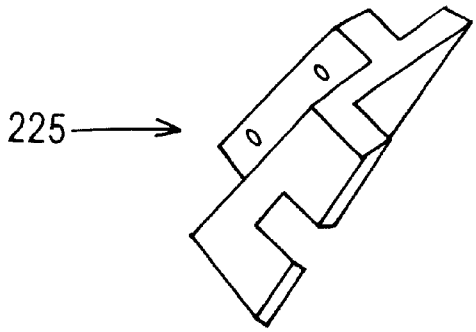
FIGS. 3A–3C are perspective views of interchangeable tips for the adjustment tool of the present invention.
Figure 3B:
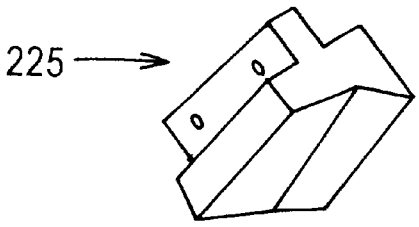
Figure 3C:
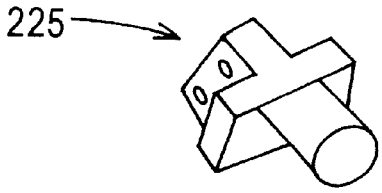

Adjustment tool 200 further comprises a second arm 215 pivotably mounted relative to first arm 205 via links 220 at points P, and has a second tip 225 detachably mounted to one end 215*a*. Second tip 225 can comprise a flat aluminum or steel plate 225*a* for engaging one the members to be adjusted, such as the frame or inner body of a vehicle, and is typically covered with a resilient material 225*b*, such as synthetic rubber. Alternatively, second tip 225 can be wedge-shaped, as shown in FIGS. 3A and 3B, such as for engaging an upper wishbone or vehicle frame member, or pin-shaped, as shown in FIG. 3C. Second tip 225 is typically bolted to second arm 215; however, second tip 225 can alternatively be mounted using the socket and protruberance arrangement of first arm 205 and first tip 210 described above.

The configurations of first tip 210 and second tip 225 are not limited to those described herein. Tips of different configurations can be used for differently sized and/or configured vehicles as necessary.

Adjustment tool 200 further comprises an adjuster mechanism 230 for pivoting first arm 205 and second arm 215 relative to each other to adjust the distance between first tip 210 and second tip 225. Adjuster mechanism 230 includes a wedge 235 disposed between first arm 205 and second arm 215 that moves in the directions of arrows A, engaging opposing surfaces 205*d* and 215*b* of first arm 205 and second arm 215, respectively, to pivot arms 205, 215 relative to each other in the directions of arrows B. Wedge 235 is threadably engaged with a threaded rod 240, which extends through, and is rotatably supported by, a reaction member 245 between links 220. Threaded rod 240 terminates with an end 250, such as a swivel, engagable with a ratchet (not shown) via a recess 250*a*; e.g., a ½ inch square recess for engaging with a standard ½ inch drive ratchet. Swivel 250 allows adjuster 230 to be operated in restricted spaces.

To operate adjustment tool 200, tips 210, 225 are installed on arms 205, 215, respectively. Tool 200 is then positioned between the vehicle members to be adjusted. A ratchet is attached to recess 250*a* of swivel 250, either directly or with an extension (not shown) as necessary depending on the space restrictions of the vehicle. Swivel 250 is then rotated with the ratchet in a direction indicated by arrows C, thereby moving wedge 235 to force arms 205, 215 apart until tips 210, 225 bear against the members and perform the necessary adjustment. After the adjustment procedure is completed, swivel 250 is rotated in the opposite direction, allowing arms 205, 215 to close, and tool 200 to be removed from the vehicle.

Figure 4:
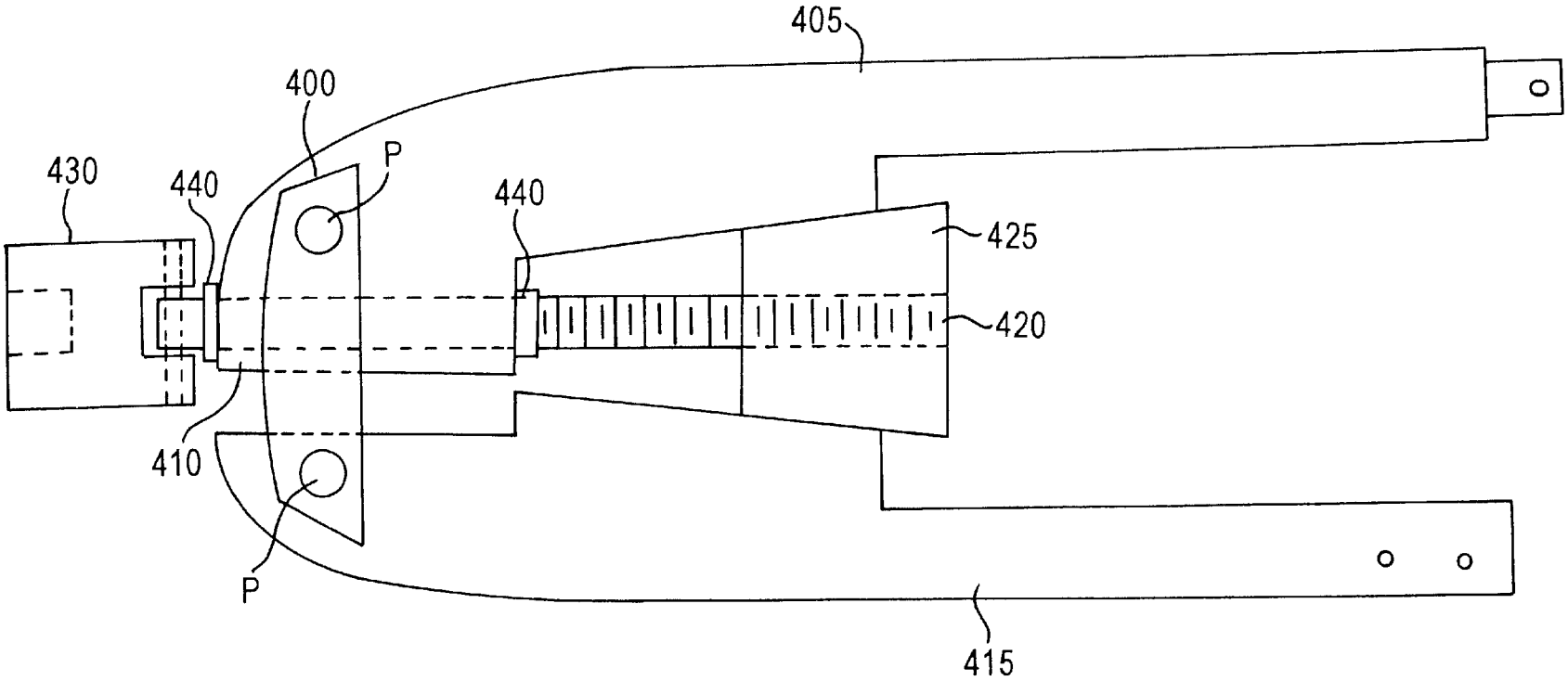
FIG. 4 schematically illustrates an adjustment tool according to another embodiment of the present invention.

FIG. 4 depicts another embodiment of the present invention, wherein arms 405, 415 are pivoted at points P by links 400, and reaction member 410 is integrally formed with first arm 405, such as by casting first arm 405 and reaction member 410 together. Threaded rod 420 is rotatably retained in reaction member 410 by collars 440, and terminates at one end inside wedge 425 and at the other end at swivel 430.

Figure 5:
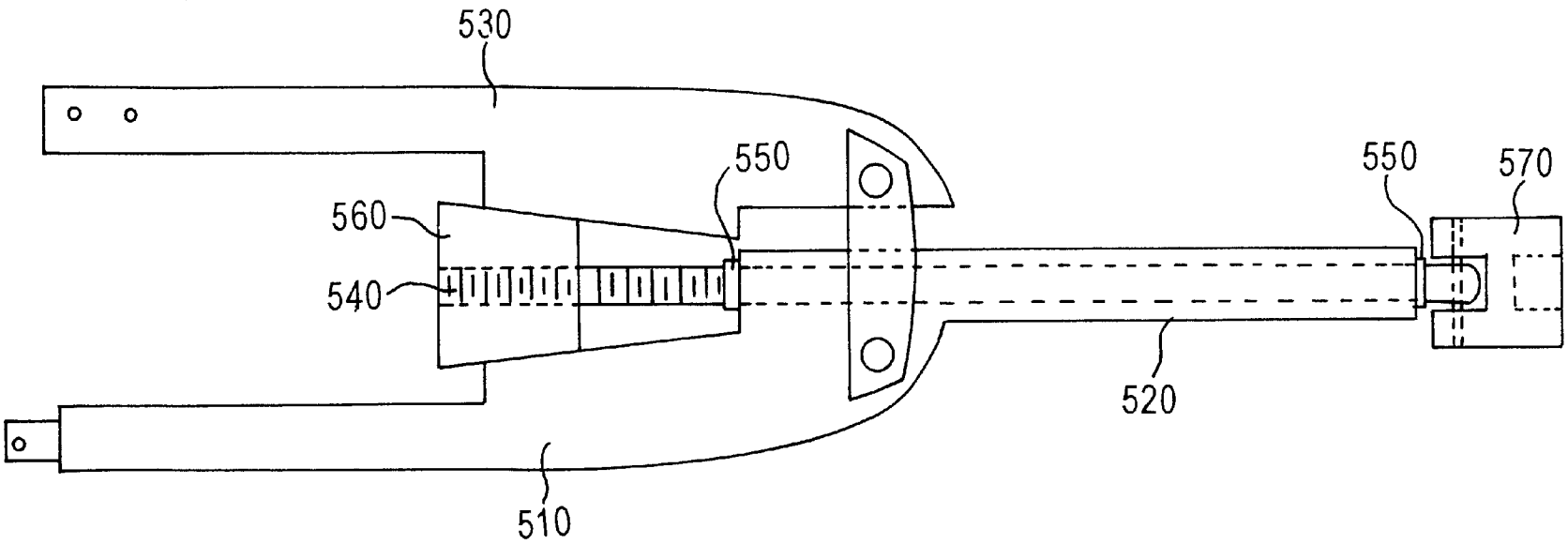
FIG. 5 schematically illustrates an adjustment tool according to a further embodiment of the present invention.

In a further embodiment of the present invention, as shown in FIG. 5, first arm 510 comprises a handle 520 in the form of a hollow tube for facilitating manual placement of tips (such as tips 210 and 225) attached to first arm 510 and second arm 530 between members to be adjusted. Threaded rod 540 extends through handle 520, is rotatably retained in handle 520 by collars 550, and terminates at one end inside wedge 560 and at the other end at swivel 570.

Figure 6:
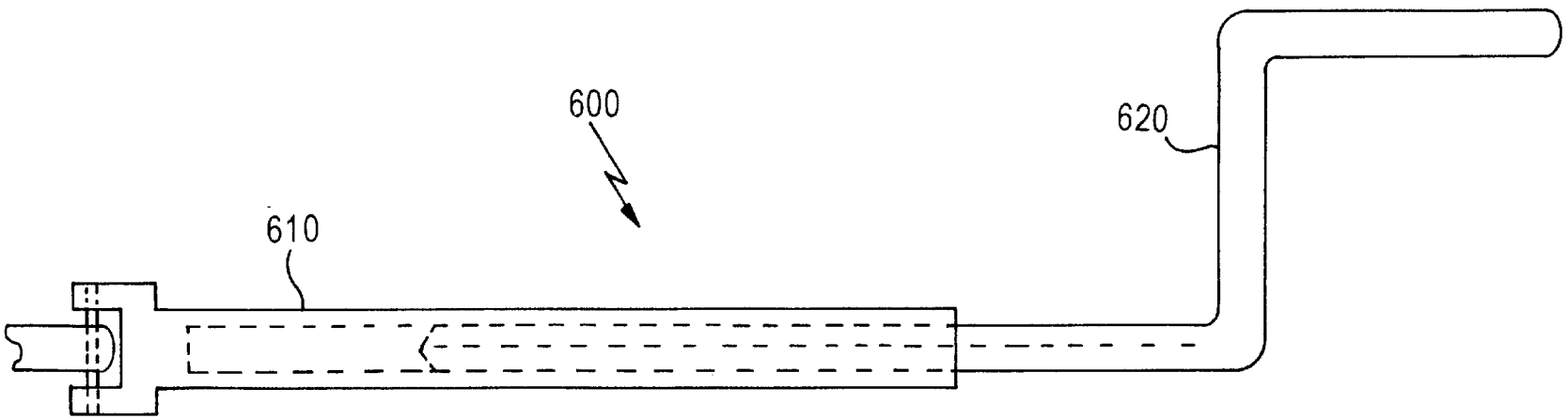
FIG. 6 schematically illustrates a handle for an adjustment tool according to the present invention.

In accord with another aspect of the present invention, as illustrated in FIG. 6, a telescoping crank handle 600 is provided for rotating the adjusting mechanism of the embodiments of FIGS. 2, 4 and 5, instead of a swivel (swivel 250, 430, 570). Telescoping crank handle 600 comprises an outer sleeve 610 that receives a crank rod 620 and attaches to the adjusting mechanism (threaded rod 240, 420, 540). The length of telescoping crank handle 600 is variable to accommodate space restrictions while performing adjustments on a vehicle.

Thus, the present invention enables adjustments to be made on vehicles of many different configurations using a single tool simply by replacing its tips, thereby reducing tool costs. For example, the inventive tool can be used to adjust both MacPherson strut and wishbone type suspensions, as well as some rear suspensions, with the attachment of appropriate tips. Interchangeable tips also allow the inventive tool easily to be adapted to service future vehicles that may have configurations different from current vehicles. Furthermore, by providing an adjusting mechanism of variable length and angle of operation, in the form of a telescoping crank handle or a swivel end engagable with a standard ratchet and extensions, the present invention may be used in tight spaces that otherwise would require use of a separate tool.

The present invention can be practiced by employing conventional materials, methodology and equipment; the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without resorting to the details specifically set forth. In other instances, well known processing structures have not been described in detail, in order not to unnecessarily obscure the present invention.

Only the preferred embodiments of the present invention and but a few examples of its versatility are shown and described in the present disclosure. It is to be understood that the present invention is capable of use in various other combinations and environments and is capable of changes or modifications within the scope of the inventive concept as expressed herein.

What is claimed is:

1. An adjustment tool for adjusting a distance between two members, the tool comprising:

a first tip for engaging a first one of the members to be adjusted;

a first arm having a first arm end structure configured to releasably couple to the first tip;

a second tip for engaging a second one of the members to be adjusted;

a second arm pivotably mounted relative to the first arm, and having a second arm end structure configured to releasably couple to the second tip; and an adjuster slidably contacting the first and second arms for pivoting the first and second arms relative to each other so as to adjust the distance between the members when the first and second tips are in contact with the members being adjusted.

2. The adjustment tool of claim 1, wherein one of the first and second tips comprises a substantially flat plate for engaging one of the members to be adjusted.

3. The adjustment tool of claim 2, wherein the substantially flat plate is bolted to one of the first and second arms.

4. The adjustment tool of claim 2, wherein the substantially flat plate is covered with a resilient material.

5. The adjustment tool of claim 2, wherein the substantially flat plate comprises aluminum or steel.

6. The adjustment tool of claim 1, wherein one of the first and second tips comprises a yoke having a pair of spaced apart legs for engaging one of the members to be adjusted.

7. The adjustment tool of claim 1, wherein one of the first and second tips comprises a substantially wedge-shaped end portion for engaging one of the members to be adjusted.

8. The adjustment tool of claim 1, wherein one of the first and second tips comprises a socket-like recess, and one of the first and second arm end structures comprises a protruberance having a detent ball for retainably engaging the socket-like recess.

9. The adjustment tool of claim 1, wherein the adjuster is rotatable for pivoting the first and second arms relative to each other, and a distal end of the adjuster is engagable with a ratchet for rotating the adjuster.

10. The adjustment tool of claim 1, wherein the adjuster is rotatable for pivoting the first and second arms relative to each other, and a distal end of the adjuster comprises a telescoping crank handle for rotating the adjuster.

11. The adjustment tool of claim 1, wherein the adjuster comprises a wedge disposed between the first and second arms for engaging opposing surfaces of the first and second arms for pivoting the arms relative to each other.

12. The adjustment tool of claim 11, wherein the adjuster further comprises:

a reaction member substantially fixedly supported between the first and second arms relative to a longitudinal axis of the first and second arms; and a threaded rod extending through the reaction member, a first distal end of the threaded rod threadably engagable with the wedge for moving the wedge relative to the first and second arms, and a second distal end of the threaded rod engagable with a ratchet for rotating the threaded rod.

13. The adjustment tool of claim 12, wherein the reaction member is integral with one of the first and second arms.

14. The adjustment tool of claim 12, further comprising a handle attached to one of the first and second arms for facilitating manual placement of the first and second tips between the members to be adjusted.

15. The adjustment tool of claim 14, wherein the handle comprises a hollow tube, and the threaded rod extends through the hollow tube.

16. The adjustment tool of claim 12, wherein the second distal end of the threaded rod comprises a swivel for engaging the ratchet.

17. The adjustment tool of claim 1, comprising a link member, the first and second arms being pivotably mounted to the link member.

18. An adjustment system, comprising:

an adjustment tool having a first arm and a second arm pivotably mounted relative to the first arm; and a plurality of tips for engaging members to be adjusted, the tips being removably mountable to distal ends of the first and second arms, respectively;

wherein the adjustment tool further comprises an adjuster slidably contacting the first and second arms for moving the first and second arms relative to each other to adjust a distance between the members when the tips are mounted at the distal end of the first arm and the distal end of the second arm and the first and second tips are in contact with the members being adjusted.

19. The system of claim 18, wherein the plurality of removable tips is selected from the group including a tip having substantially flat plate for engaging one of the members to be adjusted, a tip having a yoke with a pair of spaced apart legs for engaging one of the members to be adjusted, and a tip having a wedge-shaped end portion for engaging one of the members to be adjusted.

20. An automotive suspension alignment tool comprising:

a first tip for engaging a first suspension member;

a first arm having a first arm end structure configured to releasably couple to the first tip;

a second tip for engaging a second suspension member;

a second arm pivotably mounted relative to the first arm, and having a second arm end structure configured to releasably couple to the second tip; and an adjuster for pivoting the first and second arms relative to each other to adjust a distance between the first and second tips, thereby adjusting a distance between the first and second suspension members.

* * * * *